US007162956B2

(12) United States Patent
Dobberstein et al.

(10) Patent No.: US 7,162,956 B2
(45) Date of Patent: Jan. 16, 2007

(54) METHOD AND CONTROL DEVICE FOR DETERMINING A REGISTER ERROR

(75) Inventors: Dieter Karl-Heinz Dobberstein, Melsdorf (DE); Walter Dworschak, Gettorf (DE); Christian Friedrich Engeln, Kronshagen (DE); Heiko Hunold, Wattenbek (DE); Patrick Metzler, St. Wendel (DE); Karlheinz Walter Peter, Molfsee (DE); Rolf Johannes Spilz, Gettorf (DE); Stefan Theden, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 604 days.

(21) Appl. No.: 10/635,260

(22) Filed: Aug. 6, 2003

(65) Prior Publication Data

US 2006/0013468 A1 Jan. 19, 2006

(30) Foreign Application Priority Data

Sep. 7, 2002 (DE) ..... 102 41 609

(51) Int. Cl.
*B41F 1/34* (2006.01)

(52) U.S. Cl. ..... 101/485; 101/486; 399/394

(58) Field of Classification Search ..... 101/483–486, 101/578, 579, 582; 347/116; 271/227, 228, 271/250; 382/151; 399/301, 394–395
See application file for complete search history.

(56) References Cited

U.S. PATENT DOCUMENTS

| | | | | |
|---|---|---|---|---|
| 5,718,057 | A * | 2/1998 | Rosli et al. | 33/617 |
| 6,619,209 | B1 * | 9/2003 | Dreher et al. | 101/485 |
| 6,718,879 | B1 * | 4/2004 | Dreher et al. | 101/485 |
| 6,848,361 | B1 * | 2/2005 | Metzler | 101/216 |
| 6,920,292 | B1 * | 7/2005 | Metzler | 399/51 |
| 6,997,455 | B1 * | 2/2006 | Romine | 271/227 |
| 2002/0024681 | A1 | 2/2002 | Leonhardt | |

FOREIGN PATENT DOCUMENTS

| | | |
|---|---|---|
| EP | 0 521 158 A1 | 1/1993 |
| EP | 0 541 260 A1 | 5/1993 |

* cited by examiner

*Primary Examiner*—Minh Chau
(74) *Attorney, Agent, or Firm*—Lawrence P. Kessler

(57) ABSTRACT

A method and control device for determining a register error, whereby at least one register mark is printed and at least one sensor records the register mark, whereby the sheet edge of the sheet is recorded by the sensor, and the register error is determined from the sensor data and the target data.

7 Claims, 3 Drawing Sheets

METHOD AND CONTROL DEVICE FOR DETERMINING A REGISTER ERROR

FIELD OF THE INVENTION

The invention relates to a method and a control device for determining register error from sensor data and target data.

BACKGROUND OF THE INVENTION

In the printing of sheets of paper or similar materials using printing machines, the correct positioning print of the printing image on the sheet is of considerable importance. This characteristic is designated by the term "registerability". To determine the registerability, register marks are applied in addition to the printed image, whose deviations from the correctly positioned printing are determined and measured by the operator of the printing machine. Due to an improvement in this method, the registerability is automatically determined and calculated by sensors in the printing machine. To this end, the sensors record the register marks on the sheet and, by the measured position of the register mark and a target position, determine whether or not the printing is taking place correctly. In case of register deviations or register errors, the printing machine is instructed accordingly in order to correct them. The disadvantage of the state-of-the-art method is that under the same conditions, register marks are applied undesirably at different locations with various types of printing materials. For example, if a thick print substrate is used, the register marks are applied at a marginally different location than if a thin print substrate is used. Such errors are regularly corrected, whereby the availability of the printing machine is diminished by the correction measures that are usually carried out with special calibration runs. Another disadvantage with the state-of-the-art method described is the high number of detection components. In addition, with the state-of-the-art method described, each sheet is stopped to check its alignment, which takes a considerable amount of time.

SUMMARY OF THE INVENTION

In view of the above, this invention is directed to determining a register error in a reliable and simple manner. Another object of the invention is to correct the register error.

A method and a control device to determine the register error are provided, where at least one register mark is printed and at least one sensor records the register mark, whereby the edge of the sheet is recorded by the sensor and the register error is determined from sensor data and target data.

As a result, the existing disadvantages of the state-of-the-art method described are eliminated. Moreover, only one small circuit input is required.

In one embodiment of the invention, at least two register marks are applied at a distance diagonal to the conveying direction; the register error is recorded in the conveying direction of the sheet and an angle error of the sheet is determined using the sensor data. Angle errors can be easily determined with this characteristic.

One of the embodiments of the invention discloses a method that is carried out during the printing process; the print result can be used from the first sheet onward without any waste sheets, and calibration runs of the printing machine are avoided. The printing quality is increased, since the register error is always recorded and corrected, not only during a calibration process prior to the printing process, thus identifying a register drift error that occurs with longer printing machine operating times. Eliminating the calibration process increases printing machine availability. Furthermore, there are no waste sheets that are not used because they are printed with register marks. The printed sheets are usable from the first sheet onwards.

In another embodiment of the invention, the register mark is printed on the conveyor that advances a sheet. Advantageously, the print job is usable from the first sheet onwards and there are no waste sheets.

Advantageously, the register mark and the edge of sheet are recorded during the printing process. This characteristic increases the availability of the printing machine and calibration runs preceding the printing process are avoided.

In one embodiment, a register error is recorded in the conveying direction of the sheet and in another embodiment, sheet register errors are recorded that are the result of angular displacements of the sheet.

In another embodiment of the invention, the sensor records the register mark, causing a rotation angle of a driving roller of the conveyor to be determined; the sensor records the sheet edge, causing the rotation angle of the conveyor and the rotation angle difference to be determined; the rotation angle difference is compared with a target rotation angle difference and the register error is determined from the comparison.

In addition, it also determines the register error for various types of print substrates. Advantageously, errors that are caused by the different compressibility of various print substrates with respect to registerability are avoided.

One embodiment of the invention discloses that the register error for different types of print substrates is determined and stored in an allocation table of a control device of the printing machine.

In order to obtain a reliable elimination of the register error, a number of register errors are statistically averaged. The use of statistically averaged register errors provides an additional improvement of the method.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
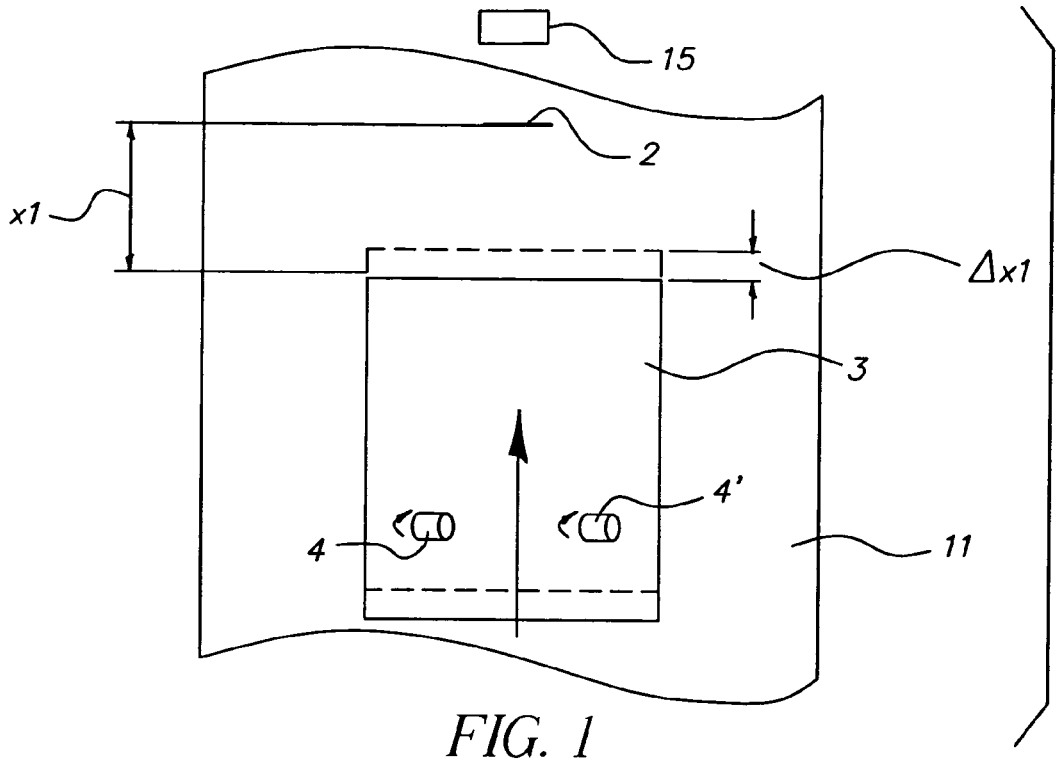
FIG. 1 shows, as one embodiment of the invention, a schematic top view of a section of a conveyor with a sheet that is offset in the longitudinal direction, a register mark on the conveyor and a sensor to record the register mark and the front edge of the sheet.

Referring now to the accompanying drawings, FIG. 1 shows an embodiment of the invention with a schematic top view of a section of a conveyor 11 with a sheet 3 displaced in the longitudinal direction. In this case, conveyor 11 is a conveyor belt, which can also be configured, however, as a drum, for example. Sheet 3 is indicated with solid lines, while the correct position of sheet 3 without the longitudinal displacement of sheet 3 is shown with dotted lines. A so-called in track error is illustrated. The distance of the erroneous longitudinal displacement of sheet 3 amounts to Δx. A register mark 2 is transferred to conveyor 11 in FIG. 1. Sheet 3 is then transferred to conveyor 11. Since register mark 2 is transferred to conveyor 11, no register errors occur that are due to the print substrate of sheet 3; register mark 2 is almost perfectly transferred to conveyor 11 with the same constant characteristics. Sensor 15, above conveyor 11 records first the register mark 2 and then the front edge of sheet 3. The distance between register mark 2 and the front edge of sheet 3 amounts to x1. The number of cycles between the recording of register mark 2 and the front edge of sheet 3 by the sensor 15 is counted by a cycle counter 20 (see FIG. 5). The number of cycles counted is related to the distance x1, since the speed of sheet 3 as well as the cycle frequency of the cycle counter is known. A number of cycles counted by the cycle counter 20 are designated as actual data. The actual data is compared with the target data, at which point a cycle difference is calculated that corresponds to the distance Δx and which can be converted into this distance. Using the allocation table or look up table, the distance Δx calculated in this manner is allocated a calibration value, which represents a correct value for the register error.

Figure 2:
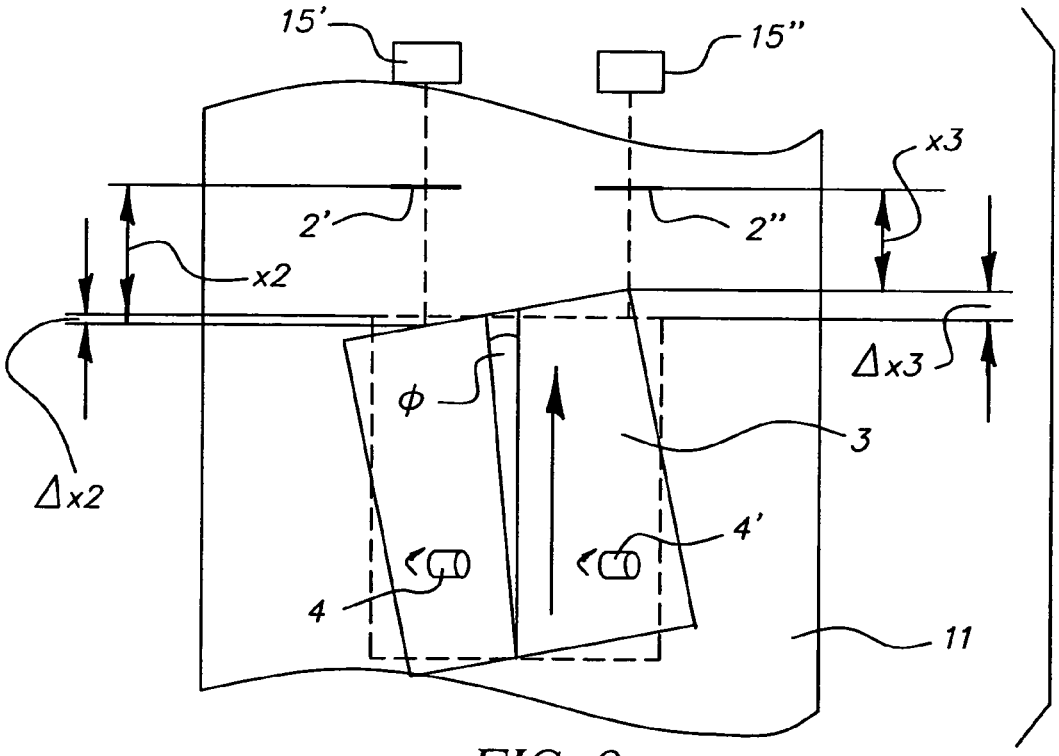
FIG. 2 shows, as one embodiment of the invention, a schematic top view of a section of a conveyor with an angular displacement of the sheet, two register marks on the conveyor and two sensors for recording the register marks and the front edge of the sheet.
Figure 3:
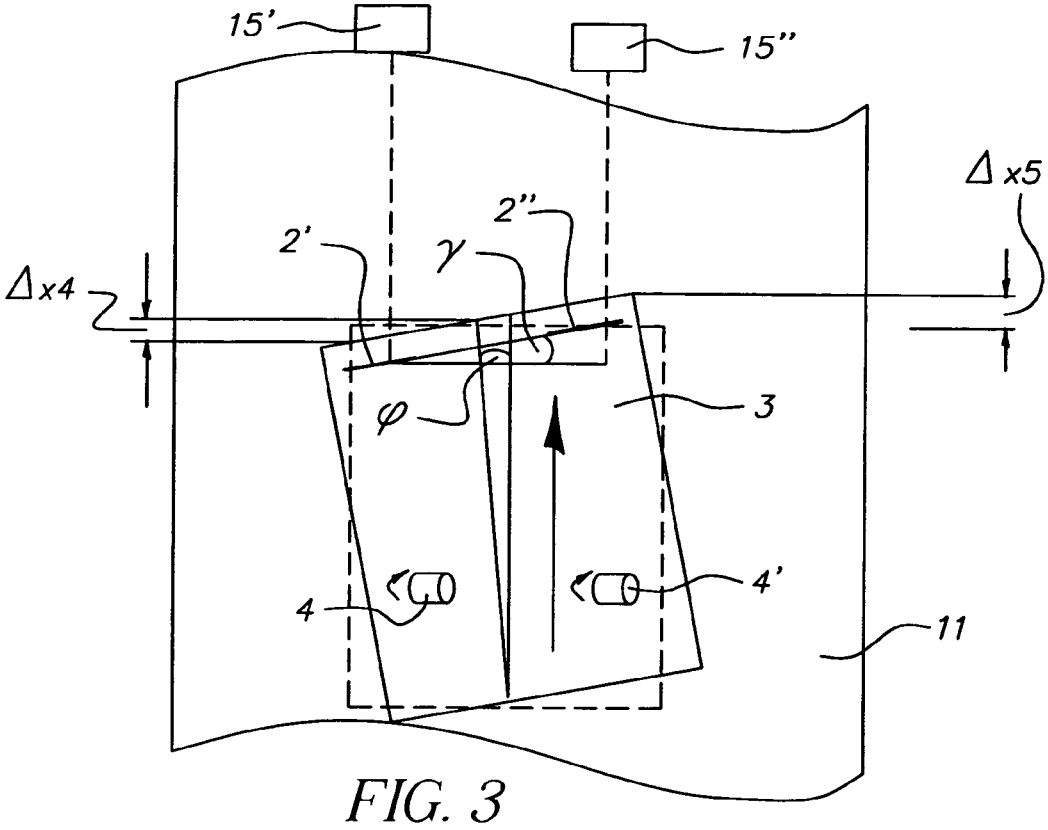
FIG. 3 shows, as one embodiment of the invention, a schematic top view of a section of a conveyor with an angular displacement of the sheet, two register marks on the sheet and two sensors for recording the register marks and the front edge of the sheet.
Figure 5:
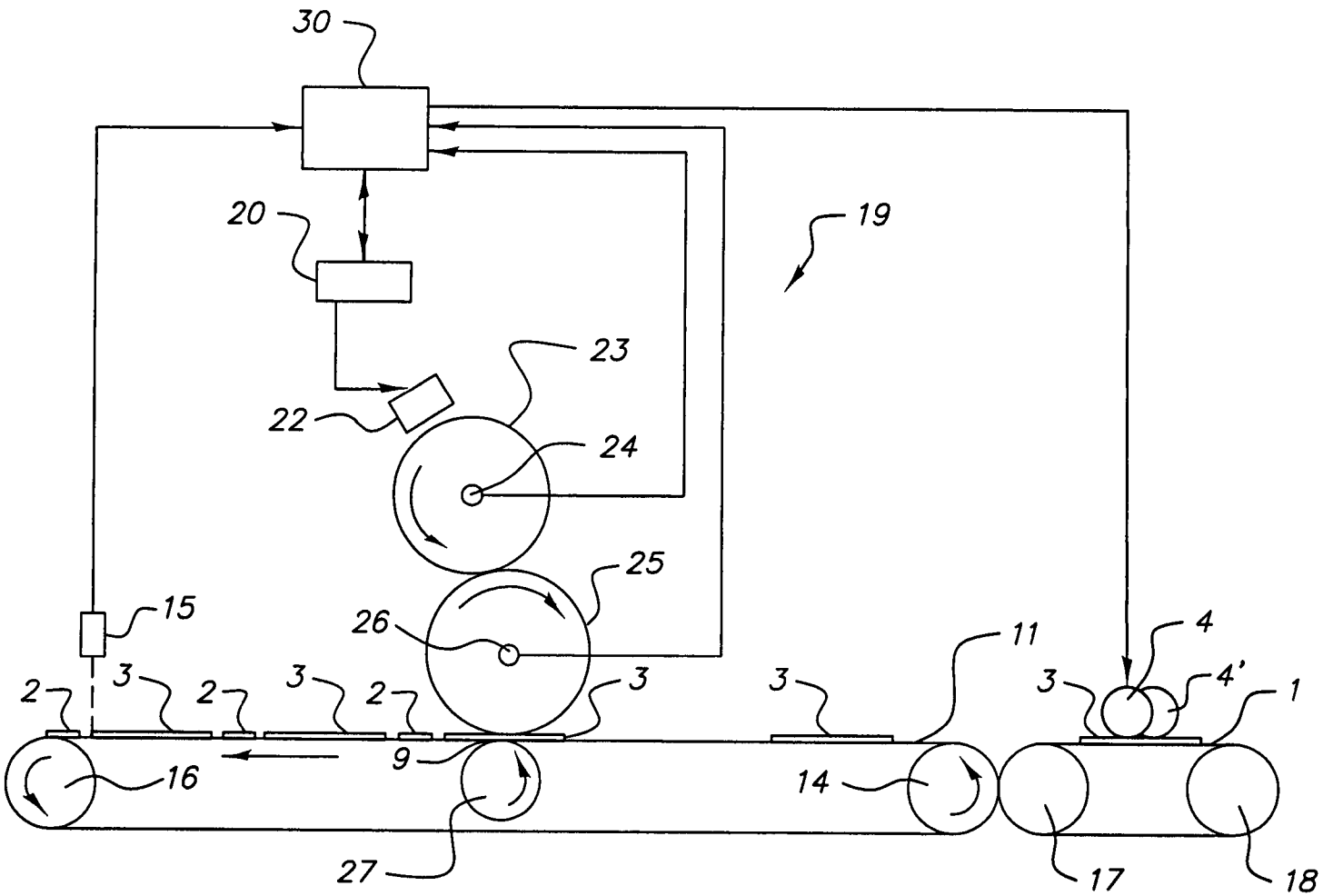
FIG. 5 shows a lateral view of a schematic diagram of a control device to determine and correct a register error.

In the example at hand, conveying rollers 4, 4' are controlled by the calibration value, which grip sheet 3 and advance it further by the distance Δx. For illustration purposes, conveying rollers 4, 4' are illustrated in FIGS. 1 to 3 to be above conveyor 11, but they are actually above conveyor 1, as shown in FIG. 5. The activation of conveying rollers 4, 4' by calibration values causes a displacement of sheet 3 by the distance Δx that is not related to the conveying of sheet 3 via conveying rollers 4, 4'. The distance Δx is covered in addition to the distance customarily covered by sheet 3. Other conveying rollers can be used, but they are not illustrated. In this manner, the displacement of sheet 3 is compensated for. In addition to using conveying rollers 4, 4', the register error in the conveying direction of sheet 3 can alternatively be corrected by activating an illustration (writer) device 22, by shifting the illustration point in time by a time allocated to the distance Δx. The process described takes place during the printing and a special calibration run is not required; the register error of sheet 3 is corrected during the conveying by the movement of sheet 3. Since the register mark 2 is not being printed on sheet 3, there is no rejection of sheet 3 and the first printed sheet 3 can already be used as the print result. Each sheet 3 and each register mark 2 that is recorded generates other calibration values that can be used individually for correction or which can be averaged, while the averaged calibration values, like the individual calibration values, can be used to correct register errors. The calibration values remain firmly stored in the allocation table. In this way, suitable calibration values to avoid register errors are available at the beginning of a printing process.

Furthermore, the register errors are contingent upon the print substrate; different print substrates generate different sizes of register errors. Since for each printing process, the type of print substrate in the printing machine is known by the input of the special printing process by the operator, the calibration values can be stored according to the print substrate. For this reason, there is a special allocation table available for each type of print substrate. At the beginning of a printing process or printing job by the printing machine, the type of print substrate is determined by printing process data, and stored calibration values are called up from the allocation table that suit the type of print substrate. In this way, calibration values that depend upon the type of print substrate are already available at the beginning of a printing job. The calibration values are used to control conveying rollers 4, 4', which compensate for the displacement of sheet 3 by the distance Δx. Conveying rollers 4, 4' are arranged at the same height regarding the conveying direction and are generally used to convey sheet 3 and grip it for this purpose. Controlled by the calibration values, conveying rollers 4, 4' are briefly accelerated or decelerated. In the example at hand, the speed of conveying rollers 4, 4' is increased in such a way that sheet 3 on conveyor 1 is additionally advanced by the distance Δx. Sheet 3, is conveyed without correction by conveying rollers 4, 4' at a linear speed, to which an additional speed is added using the calibration values, and conveying rollers 4, 4' are briefly accelerated. The additional speed compensates for the specified distance difference Δx, which represents a register error of sheet 3 in the conveying direction. Behind conveyor 1, sheet 3 is advanced to another conveyor 11 on which the printing of sheet 3 is carried out, as described under FIG. 3.

FIG. 2 shows a schematic top view of a section of a conveyor 11 with an angular displacement of sheet 3 to avoid a register error of sheet 3, which is due to an angular displacement of sheet 3. Sheet 3 is indicated with solid lines, and the correct position of sheet 3 without the angular displacement of sheet 3 is indicated with dotted lines. Sheet 3 is offset by the angle ϕ toward the left, according to FIG. 2, forming a so-called skew error. Two sensors 15', 15" are arranged above conveyor 11 at the same height with respect to the conveying direction of sheet 3. The angular displacement of sheet 3 causes the left side of sheet 3 at the location where sensor 15' records the data to be offset toward the rear by the distance Δx2, while the right side of sheet 3 at the location where sensor 15" records the data is offset toward the front by the distance Δx3. Two sensors 15' 15", are arranged at the same height perpendicular to the conveying direction of sheet 3. The two sensors 15', 15" each record the front edge of sheet 3 as well as register marks 2', 2" that are transferred to conveyor 11. Due to the angular displacement, sensor 15" picks up on register mark 2" before sensor 15' records register mark 2'. Each sensor 15', 15" generates sensor data, from which the cycle counter 20 produces a cycle difference, which corresponds to the distance x2 and x3. The distance x2 corresponds to the distance of register mark 2' from the front edge of sheet 3, measured by sensor 15', and the distance x3 corresponds to the distance of register mark 2" from the front edge of sheet 3, measured by sensor 15". For this purpose, cycle counter 20 counts the cycle which begins with the recording of register mark 2' by sensor 15' and register mark 2" by sensor 15" and which ends with the recording of sheet 3, and each forms a cycle difference. Distance difference Δx2 corresponds to the displacement of sheet 3 based on the angular difference at the location where sensor 15' records the front edge of sheet 3, each in relationship to the correct position of sheet 3, which is indicated by dotted lines. The cycle difference from the sensor data of sensor 15' is compared with the cycle difference from the sensor data of sensor 15" in device 30. From the comparison of the cycle differences, a calibration value is unequivocally obtained by comparing the cycle differences, which is the result of the angular displacement of sheet 3. In the example according to FIG. 2, the device 30 controls conveying roller 4 and accelerates it. Conveying roller 4' is further moved with comparable speed, while the speed of conveying roller 5 is increased in such a way that the angular displacement of sheet 3 is compensated for by angle ϕ. The left side of sheet 3 is consequently advanced at another speed than the right side for a short time.

FIG. 3 shows another embodiment of the invention with a schematic top view of a section of a conveyor 11 with an angular displacement of sheet 3, to avoid a register error of sheet 3, which is due to an angular displacement of sheet 3. Sheet 3 is indicated by solid lines, while the correct position of sheet 3, without an angular displacement of sheet 3, is indicated by dotted lines. Sheet 3 is displaced to the left by angle ϕ, according to FIG. 2, causing a so-called skew error. Two sensors 15', 15" are arranged above conveyor 11 at the same height with respect to the conveying direction. The angular displacement of sheet 3 causes the left side of sheet 3 at the location where sensor 15' records the data to be displaced toward the rear by the distance Δx4, while the right side of sheet 3 at the location where sensor 15" records the data is displaced by the distance Δx5 toward the front with respect to the conveying direction. Two sensors 15', 15" are arranged at the same height perpendicular to conveying direction of sheet 3. The two sensors 15', 15" each record the front edge of sheet 3 as well as register marks 2', 2", respectively, which is transferred to sheet 3. Due to the angular displacement, sensor 15" records the register mark 2" before sensor 15' records the register mark 2'. Each sensor 15', 15" generates sensor data, from which cycle counter 20 produces a cycle difference. The distance difference Δx4 corresponds to the displacement of sheet 3 due to angular displacement at the location that the sensor 15' records the front edge of sheet 3, each in relationship to the correct position of sheet 3. The cycle difference taken from the sensor data of sensor 15' is compared with cycle difference taken from the sensor data of sensor 15" in device 30. From the comparison of the cycle differences, a calibration value is unequivocally obtained, which can be attributed to an angular displacement of sheet 3. The calibration value is used subsequently to correct the register error.

In the example according to FIG. 3, device 30 controls conveying roller 4 and accelerates it. Conveying roller 4' is moved further at the same speed, while the speed of conveying roller 4 is increased in such a way that the angular displacement is compensated for by the angle ϕ. The left side of sheet 3 is consequently advanced at a different speed than the right side. It should be noted at this point that, unlike embodiment according to FIG. 2, the register marks 2', 2" are transferred to sheet 3 and not to conveyor 11. As a result, sheet 3 with the embodiment according to FIG. 3, contrary to the embodiment according to FIG. 2, cannot be used as a print result; sheet 3 will be rejected. The method of the embodiment according to FIG. 3 is run through a special calibration run, which takes place prior to the printing process.

Figure 4:
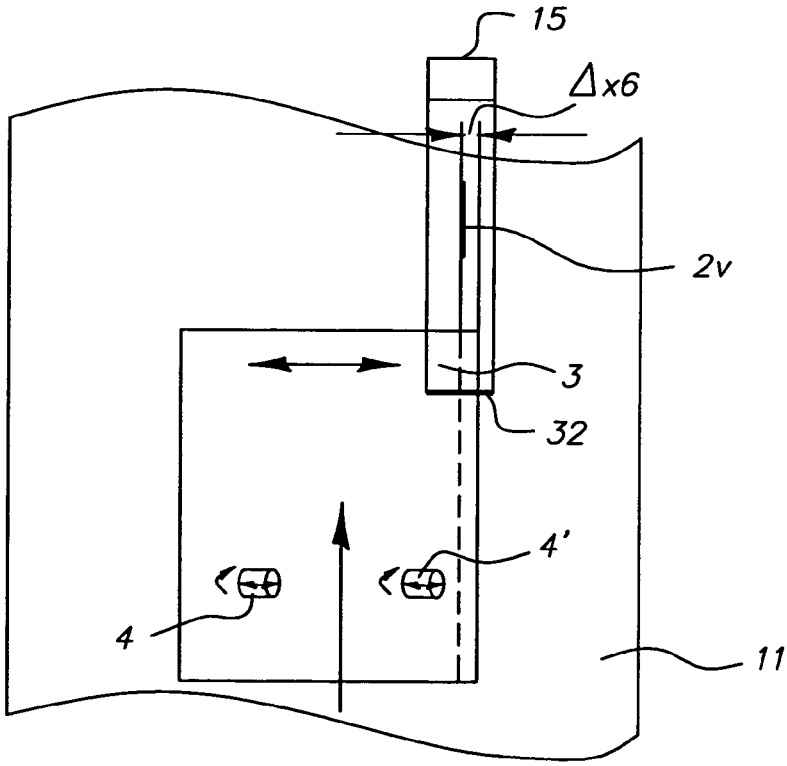
FIG. 4 shows, as one embodiment of the invention, a schematic top view of a section of a conveyor with a sheet displaced perpendicularly to the conveying direction, a register mark on the conveyor and a sensor to record the register mark and the margin of the sheet.

FIG. 4 shows a particular embodiment of the invention, whereby register errors are identified, that are defined by a shifting of sheet 3 perpendicular to the conveying direction of sheet 3. In this case, sheet 3 is shifted by a distance Δx6 to the right perpendicular to the conveying direction of sheet 3. The correct position of sheet 3 on the conveyor 11 is indicated by dotted lines, while the erroneous position of sheet 3 is indicated by solid lines. The register error perpendicular to the conveying direction of sheet 3, a so-called cross-track error, is the size of Δx6 in FIG. 4. The erroneous direction is indicated by the double-sided arrow in FIG. 4. In order to identify the register error displayed, sensor 15 is arranged above sheet 3 approximately in the area of the margin of sheet 3. A register error $2^v$ is transferred to conveyor 11 as a perpendicular beam, i.e. the register mark $2^v$ lies parallel to the margins of sheet 3, provided that sheet 3 has no angular displacement. The register error is detected by sensor 15 recording the register mark $2^v$ and subsequently at least one margin of sheet 3. In this embodiment, sensor 15 includes approximately one LED array or one CCD array, whereby approximately one section 32, which is indicated with a dotted line in which a section of the margin of sheet is located, is recorded by sensor 15. In a correct position, the register mark $2^v$ is preferably located on the same line, as viewed in the conveying direction, as the margin of sheet 3. The erroneous position of the margin of sheet 3 is determined in relationship to register mark $2^v$. The distance Δx6 can be determined on the basis of the measurements taken by sensor 15, similar to the above description.

A correction of the register error, which in the present case is a displacement of sheet 3 to the left by the distance Δx6, is carried out in such a way that conveying rollers 4, 4' are controlled accordingly by the device 30 and are displaced to the left by the distance Δx6. Due to a frictional contact with sheet 3, the latter is displaced by the same distance to the left as conveying rollers 4, 4'. The recording and correction of the register error takes place during the printing process as described.

FIG. 5 shows a schematic lateral view of part of a printing module or printing unit of a multicolor printing machine above a conveyor 11 as well as a control device 19. In an exemplary fashion, an embodiment of the invention according to FIG. 1 is illustrated, whereby a single sensor 15 and a single register mark 2 per sheet 3 is provided and a sheet displacement in the longitudinal direction to the conveying direction that can be identified and corrected. In a similar manner, an embodiment can be configured for identifying and correcting an angular displacement of sheet 3. Conveyor 11 follows conveyor 1, which is illustrated in a section of FIG. 5; sheet 3 is advanced from conveyor 1, which is stretched around rollers 17, 18, to conveyor 11.

As a result, sheet 3 moved forward by conveying rollers 4, 4', which grip sheet 3; conveyor 1 is fixed at this point. The printing machine usually has several printing modules located in sequence; each printing module applies one color, whereby the individual colors are printed on top of one another on a print substrate, which in this case is sheet 3, to compose a total image, as is known. Conveyor 11 is powered by the drive of a second deflection roller and moves in the direction of the arrow. In FIG. 5, the first deflection roller 14, the second deflection roller 16, an intermediate drum 25, an illustration drum 23, and a central impression drum 27, to provide a counter force to the printing or compressive force of the intermediate drum 25, move in the directions indicated by the respective curved arrows. In the present description, the illustration drum 23 and the intermediate drum 25 are the sub-carrier of the printing image, depending on whether the image is directly transferred to sheet 3 by the illustration drum 23, or is first transferred to an intermediate drum 25 and from there to sheet 3. The illustration drum 23 and the intermediate drum 25 have a first rotary encoder 24 and a second rotary encoder 26, which respectively record a specified rotation angle of the illustration drum 23 and of the intermediate drum 25, so that each of their rotation angles is known at all times. The first rotary encoder 24 on the illustration drum 23 and the second rotary encoder 26 on the intermediate drum transmit the recorded rotation angle to a device 30.

The device 30 comprises allocation tables or look up tables, which are set up in the form of a register, which receives data from the first rotary encoder 24, from the second rotary encoder 26, from the drive at the second deflection roller 16 and from a sensor 15 or register sensor, and assigns cycle numbers, respectively. The cycle numbers obtained from the look up tables are used to fix the time for beginning the illustration of the illustration drum 23 with an image. In this context, the term image comprises in this connection color separations of images of individual printing modules that compose an overall image, e.g., color separations cyan, magenta, yellow and black with four-color printing, individual lines of the image or an image range. FIG. 5 shows only a single printing module for a color separation (cyan, magenta, yellow, or black); other printing modules are located sequentially along conveyor 11.

According to a predetermined number of cycles set by device 30, the cycle counter 20 transmits a signal to an illustration device 22, which, as a result of the signal, transmits an electrostatic image to the illustration drum 23. For this purpose, the illustration drum 23 has an electrostatically charged photoconductor, which is exposed by the illustration device 22 with focused light, either by an LED source or a laser. At the places at which the focused light meets the electrostatically charged photo-conducting layer of the illustration drum 23, electrostatic charges are removed. Subsequently, pigmented toner particles with magnetically opposed charges are applied to the places devoid of the electrostatic charges and develop an image on the illustration drum 23. The developed image is transferred to an intermediate drum 25, which counter-rotates, to the illustration drum 23, and which is then printed on sheet 3 by the intermediate cylinder 25 by transfer from the intermediate cylinder 25. The intermediate drum 25 exerts a force from above on conveyor 11, and a central impression drum 27 exerts a force opposing the intermediate drum 25 on conveyor 11 from below.

The illustration drum 23, the intermediate drum 25, the first deflection roller 14 and the central impression drum 27 are driven by contact friction with conveyor 11, which is driven by a drive at the second deflection roller 16. The illustration that is triggered by illustration device 22, which is released by the cycle counter 20, takes place at the exact moment that the developed image is transferred to the sheet 3 via the intermediate drum 25 by illustration drum 23. It is assumed here that sheet 3 is conveyed accurately from conveyor 1 to conveyor 11. Register mark 2 is, as described, transferred from intermediate drum 25 to conveyor 11. Sensor 15 at the end of conveyor 11 records first register mark 2 on conveyor 11 and thus transmits a signal to device 30, which triggers a counting of a cycle of the cycle counter 20. Subsequently, sensor 15 records the front edge of sheet 3 and thus transmits a signal to device 30, which stops the counting of the cycle. Each register mark 2 follows sheet 3. Between the detection of register mark 2 and the front edge of sheet 3, a cycle count is taken, which refers to the distance x1 between register mark 2 and the front edge of sheet 3.

The cycle count clearly refers to a distance; here in the example, the distance x1 can be allocated. The cycle count taken refers to the actual data that is compared in device 30 with target data. If the result of the comparison is that the actual data matches the target data, there is no register error. If the result of the comparison is that the actual data do not match the target data, there is a register error, which is greater, the greater the deviation between the actual data and the target data is; the greater the distance Δx, the greater the deviation between the actual data and the target data. The distance difference Δx calculated in this manner is allocated a calibration value in the allocation table of device 30. Conveying rollers 4, 4', which are arranged above conveyor 1 and which convey sheet 3, are controlled with the calibration value. Conveying rollers 4, 4' usually advance sheet 3 uniformly and are accelerated negatively or positively to avoid a register error. In the example in FIG. 1, conveying rollers 4, 4' are accelerated in such a way that sheet 3 is additionally moved forward by the distance Δx. Sheet 3 reaches conveyor 11 at the right time, so that the printing by intermediate drum 25 is correctly carried out. Sheet 3 is thus transferred in the correct positional arrangement with respect to the conveying direction of conveyor 1 on conveyor 11. With alternative or additional application of the embodiment according to FIG. 4, sheet 3 is also transferred in the correct positional arrangement regarding the direction perpendicular to the conveying direction of sheet 3 to conveyor 11.

The invention has been described in detail with particular reference to certain preferred embodiments thereof, but it will be understood that variations and modifications can be effected within the spirit and scope of the invention.

What is claimed is:

1. Method to determine a register error in a printing machine, whereby at least one register mark (2, 2', 2", 2''') is printed and at least one sensor (15, 15') records the at least one register mark (2, 2', 2", 2'''), comprising the steps of: sensing and recording the sheet edge of the sheet (3, 3', 3", 3''') by the sensor (15, 15'), determining register error from sensor data and target data, the register error being determined for various types of print substrates and stored in an allocation table of a control device in the printing machine.

2. Method to determine a register error according to claim 1, wherein the register mark (2, 2', 2", 2''') is printed on a conveyor (11) to advance a sheet (3, 3', 3", 3''').

3. Method to determine a register error according to claim 1, wherein the recording of the register mark (2, 2', 2", 2''') and the sheet edge of the sheet (3, 3', 3", 3''') is carried out during the printing process.

4. Method to determine a register error according to claim 1, wherein a register error is recorded in the conveying direction of the sheet (3, 3', 3", 3''').

5. Method to determine a register error according to claim 1, wherein a register error perpendicular to the conveying direction of sheet (3, 3', 3", 3''') is detected, whereby the sensor (15, 15') records at least one side edge of the sheet (3, 3', 3", 3''').

6. Method to determine a register error according to claim 1, wherein at least two register marks (2, 2', 2", 2''') are applied at a distance at right angles to the conveying direction; the register error is detected in the conveying direction of the sheet, and an angle error of the sheet (3, 3', 3", 3''') is determined from the sensor data.

7. Method to determine a register error according to claim 1, wherein a number of register errors are statistically averaged.

* * * * *